US011174097B2

(12) United States Patent
Schenone

(10) Patent No.: US 11,174,097 B2
(45) Date of Patent: Nov. 16, 2021

(54) CAPSULE FOR THE PREPARATION OF INFUSION OR SOLUBLE BEVERAGES IN LOW PRESSURE EXTRACTION SYSTEMS

(71) Applicant: BISIO PROGETTI S.P.A., Alessandria (IT)

(72) Inventor: Matteo Schenone, Alessandria (IT)

(73) Assignee: BISIO PROGETTI S.P.A., Alessandria (IT)

( * ) Notice: Subject to any disclaimer, the term of this patent is extended or adjusted under 35 U.S.C. 154(b) by 97 days.

(21) Appl. No.: 16/493,951

(22) PCT Filed: Apr. 17, 2018

(86) PCT No.: PCT/IB2018/052658
§ 371 (c)(1),
(2) Date: Sep. 13, 2019

(87) PCT Pub. No.: WO2018/193374
PCT Pub. Date: Oct. 25, 2018

(65) Prior Publication Data

US 2021/0114801 A1 Apr. 22, 2021

(30) Foreign Application Priority Data

Apr. 19, 2017 (IT) ..... 102017000043013

(51) Int. Cl.
*B65D 85/804* (2006.01)

(52) U.S. Cl.
CPC ..... *B65D 85/8055* (2020.05); *B65D 85/8043* (2013.01)

(58) Field of Classification Search
CPC ..... B65D 85/8043; B65D 85/8055
See application file for complete search history.

(56) References Cited

U.S. PATENT DOCUMENTS

| | | | | |
|---|---|---|---|---|
| 9,567,155 | B2 | 2/2017 | Bartoli et al. | |
| 9,902,555 | B2 | 2/2018 | Talon et al. | |
| 2017/0073153 | A1* | 3/2017 | Bartoli | B65D 1/42 |

FOREIGN PATENT DOCUMENTS

| | | | |
|---|---|---|---|
| WO | 2013136210 | A1 | 2/2013 |
| WO | 2014053638 | A1 | 4/2013 |
| WO | 20150136433 | A1 | 3/2015 |
| WO | 20150124558 | A1 | 8/2015 |

* cited by examiner

*Primary Examiner* — Viren A Thakur
*Assistant Examiner* — Chaim A Smith
(74) *Attorney, Agent, or Firm* — Arent Fox LLP; Michael Fainberg

(57) ABSTRACT

The capsule includes: a cup defining an internal volume and closed at the top by a lid fixed to an upper edge; a sealing disc fixed internally to the cup on a lower edge, adapted to divide the internal volume into a containing volume for the food product to be infused or dissolved, and a mixing volume for optimal mixing of the food substance in the extraction fluid, said sealing disc, being adapted to seal the containing volume tightly at the base and then to detach from the lower edge due to the pressure exerted by the fluid; a mixing element positioned in the cup between the sealing disc and the lower wall, adapted to create vorticity in the fluid to allow a correct mixing of the food substance.

5 Claims, 5 Drawing Sheets

CAPSULE FOR THE PREPARATION OF INFUSION OR SOLUBLE BEVERAGES IN LOW PRESSURE EXTRACTION SYSTEMS

CROSS-REFERENCE TO RELATED APPLICATIONS

This application is the U.S. National Stage Application of International Patent Application No. PCT/IB2018/052658, filed on Apr. 17, 2018, which claims priority to Italian Patent Application No. 102017000043013, filed on Apr. 19, 2017, the contents of each of which is incorporated herein by reference in its entirety.

FIELD OF THE INVENTION

The object of the present invention is a capsule for the preparation of infusion or soluble beverages, designed to work with percolation systems (low pressure).

BACKGROUND OF THE INVENTION

In particular, the object of the present invention is a capsule for the packaging of concentrated products (for example in the form of powder, granules, leaves, syrup) in predetermined and single-use doses for the impromptu preparation of beverages (such as tea, coffee, herbal teas, milk, chocolate, soft drinks, etc.) by introducing a fluid (usually water) into the same capsule.

In the field of capsules for infusion or soluble beverages, the use of automatic or semi-automatic machines equipped with a discharging group adapted to produce an infusion by passing hot water through the capsule containing the extract to be infused or dissolved is known.

Still more specifically, reference is made to those systems that use capsules comprising a substantially cup-shaped body, consisting of a lower wall and a side wall, a lid that closes the body on the top and a filter bag placed within the body and inside of which is placed the powdered food substance.

Going into greater detail, the invention is aimed at those beverage production systems that inject water through the lid and extract the beverage through the lower wall of the capsule. The water injected into the capsule comes into contact with the powdered food substance inside the filter bag, which allows the beverage thus formed to pass through but retains the powdered food substance, preventing it from escaping from the capsule. Such systems comprise, in particular, beverage collection means having a needle by means of which the lower wall of the capsule is perforated to allow the beverage to flow out through the hole thus created (either between the needle and the lower wall or through a channel formed in the needle itself).

A disadvantage of such known systems is that the base of the capsule is already perforated by the lower blade of the machine at the step of closing the infusion chamber, and therefore before the fluid is injected into the same capsule. Therefore, the fluid rapidly passes through the substance to be infused, without being sufficiently diffused inside the capsule, with negative repercussions on the quality of the infused beverage.

Another disadvantage of these known systems, mainly linked to the use of soluble substances or syrups, is that the fluid injected by the machine flows easily towards the outlet without managing to completely dissolve the soluble substance or to properly mix the syrup, with negative repercussions on the quality of the beverage.

In the sector of capsules suitable for percolation systems (low pressure), there is a need for a capsule wherein the fluid passes through the substance to be infused in an optimal way, in terms of timing and mixing.

SUMMARY OF THE INVENTION

The object of the present invention is to solve the problems of the prior art while taking into account the needs of the industry.

In particular, the object of the present invention is to provide a capsule for the preparation of infusion or soluble beverages, usable in percolation systems (low pressure), wherein the perforation of the capsule is envisaged both on the lid and on the base, but the opening of the capsule for discharging the infused beverage takes place only after the detachment of an internal sealing disc due to the pressure exerted by the fluid within the capsule.

Furthermore, the object of the present invention is to provide a capsule, in particular for soluble substances or syrups, equipped with an internal mixer able to ensure the proper dissolving of the substance before discharging the beverage.

Such object is achieved by a capsule for the preparation of infused or soluble beverages according to claim 1. The dependent claims describe preferred embodiments of the invention.

BRIEF DESCRIPTION OF DRAWINGS

The features and advantages of a capsule according to the present invention will be apparent from the description given below, provided by way of non-limiting example, in accordance with the accompanying figures, wherein.

DETAILED DESCRIPTION

Figure 1:
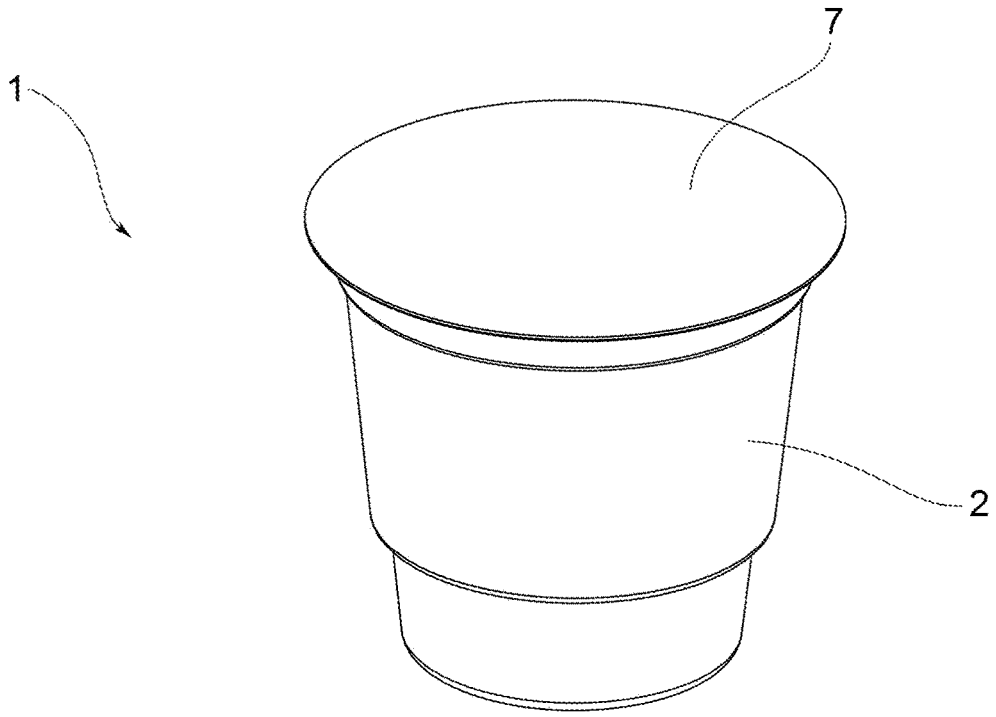
FIG. 1 shows a lateral perspective view of a capsule according to the present invention, usable in machines with percolation systems (low pressure) wherein the perforation of the capsule is provided both in the lid and in the base.
Figure 2:
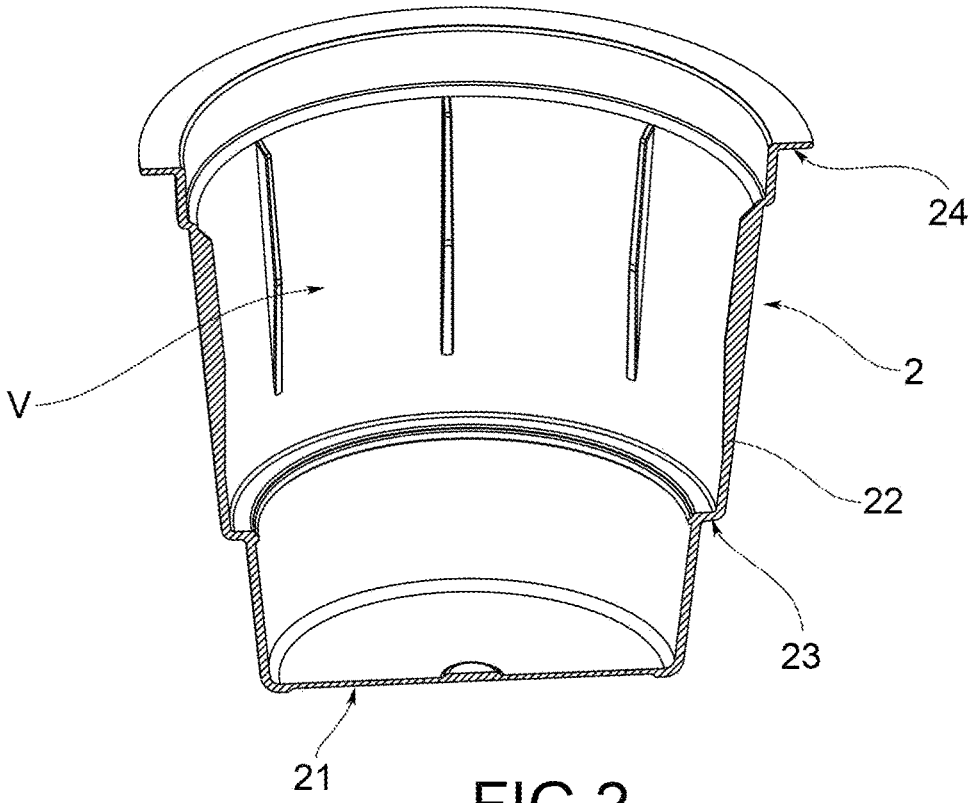
FIG. 2 shows a of a component of the capsule of FIG. 1, i.e., of the cup.

With reference to the accompanying figures, a capsule for the preparation of infused or soluble beverages is shown, indicated at reference number 1.

The capsule 1 comprises a body or cup 2 adapted to define an inner volume V.

The cup 2 is made of plastic material, preferably injection molded or thermoformed.

The cup 2 is substantially cup-shaped, comprising a lower wall 21 and a side wall 22 connected to the lower wall 21. In the preferred embodiments shown in the figures, the lower wall 21 is substantially circular and the side wall 22 has substantially conical development: consequently the cup 2 is substantially frustoconical.

The side wall 22 in particular extends from the lower wall 21 to form a lower edge 23, and then from the lower edge 23 to form a upper edge 24.

Figure 5:
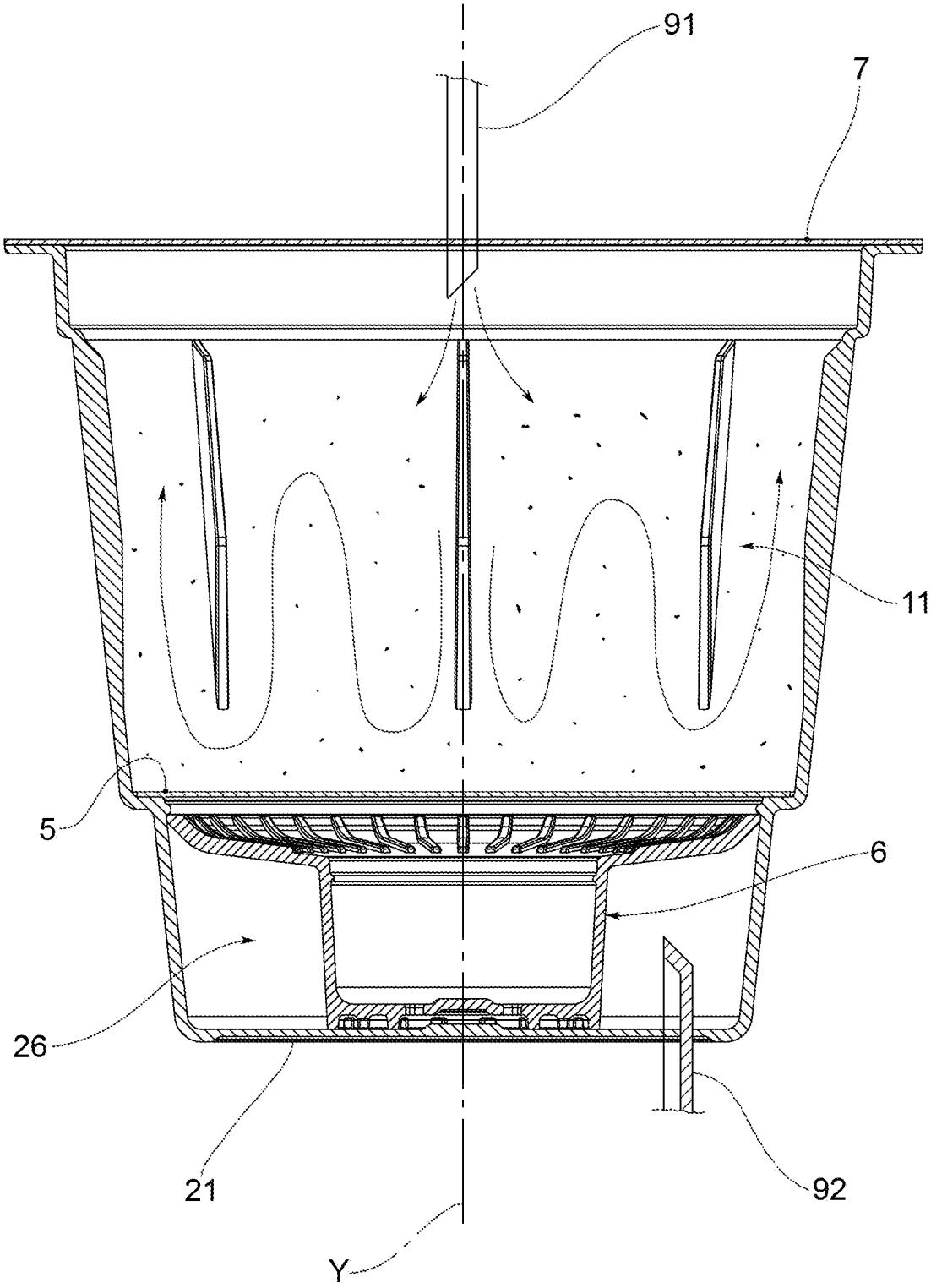
FIGS. 5 and 6 show a sectional view of the capsule of FIG. 1, respectively before and after infusion.
Figure 6:
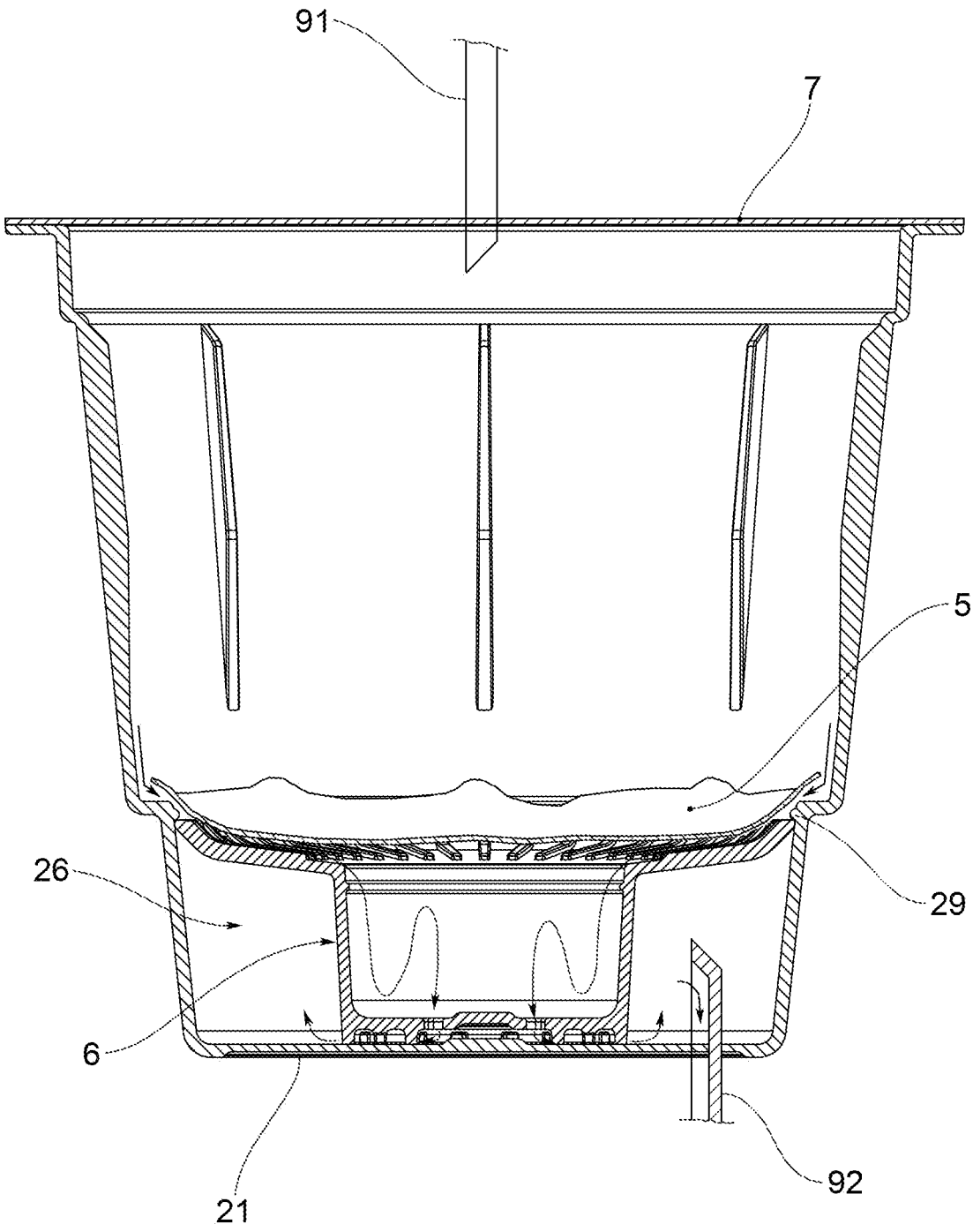

The capsule 1 then comprises a lid 7 that closes the cup 2 on top, welded at the upper edge 24. Between a central point of the lid 7 and a central point of the lower wall 21, a Y-axis of the capsule 1 is then defined, passing through said central points (FIG. 5).

The capsule 1 also comprises a sealing disc 5 inserted inside the cup 2 to separate the food substance from the lower wall 21.

In particular, the sealing disc 5 is welded at the lower edge 23.

The sealing disc 5 separates the inner volume V into two parts: a containing volume VC—upper volume, defined between the lid 7 and the sealing disc 5—for the containment of at least one substance 11 to be infused or dissolved, typically in powder form, or in granular form, or in leaves, or in syrup form; a mixing volume VM—lower, defined between the sealing disc 5 and the lower wall 21—for the proper mixture of the substance 11 with the liquid injected into the capsule 1.

It should be noted that the sealing disc 5 is adapted to seal the containing volume VC tightly below: therefore, even if the capsule 1 is perforated at the lower wall 21, the containing volume VC remains closed and sealed by the sealing disc 5. Such solution first of all allows the capsule to be filled with liquid or creamy substances or syrups without the risk of these escaping from the capsule 1 before the correct extraction of the beverage has occurred. In effect, the capsule 1 is opened for discharging the beverage only after the release of the sealing disc 5 due to the pressure exerted by the fluid inside the capsule.

Figure 3:
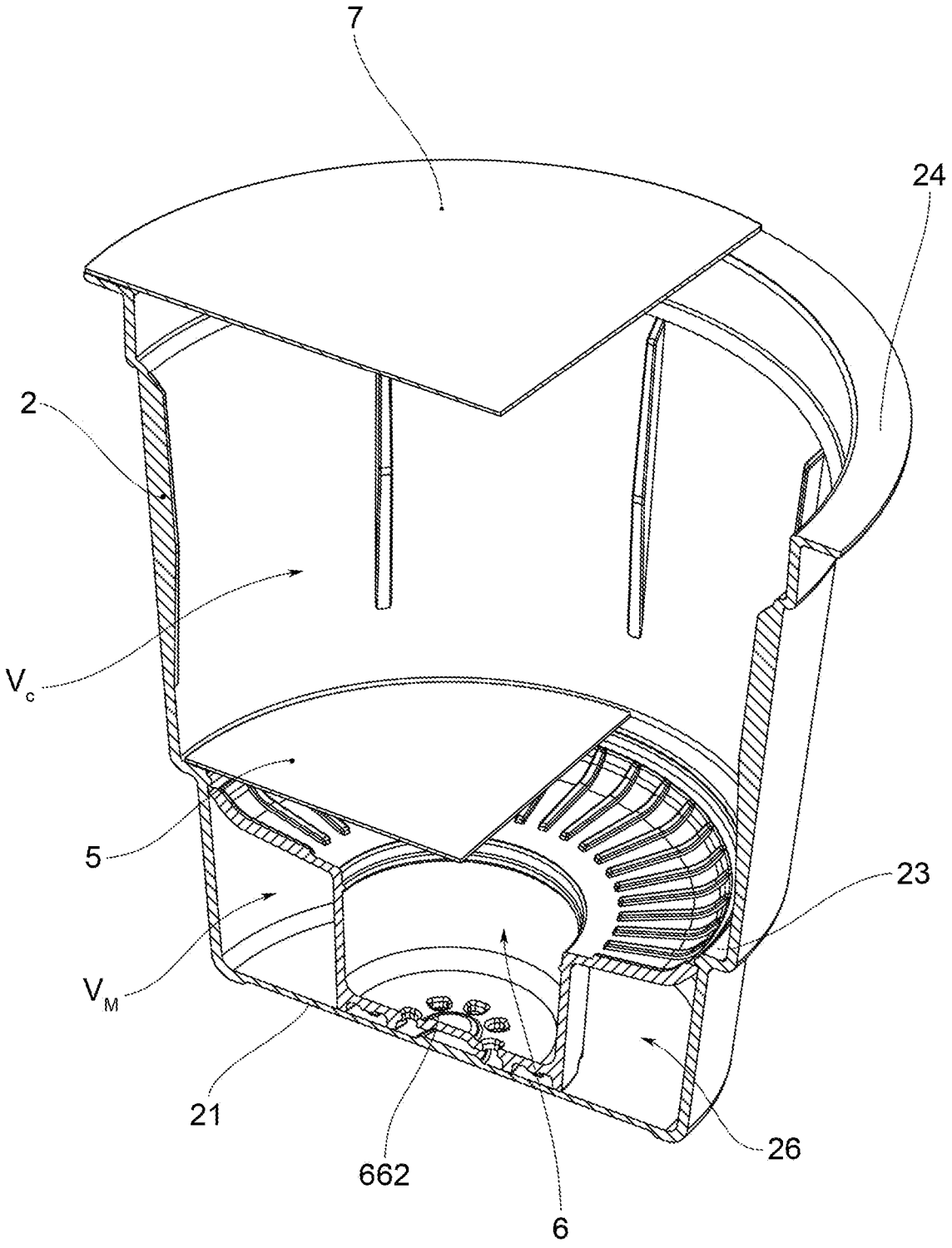
FIG. 3 shows a sectional perspective view of the capsule in FIG. 1, provided internally with a sealing disc, before infusion, and a mixing insert.
Figure 4:
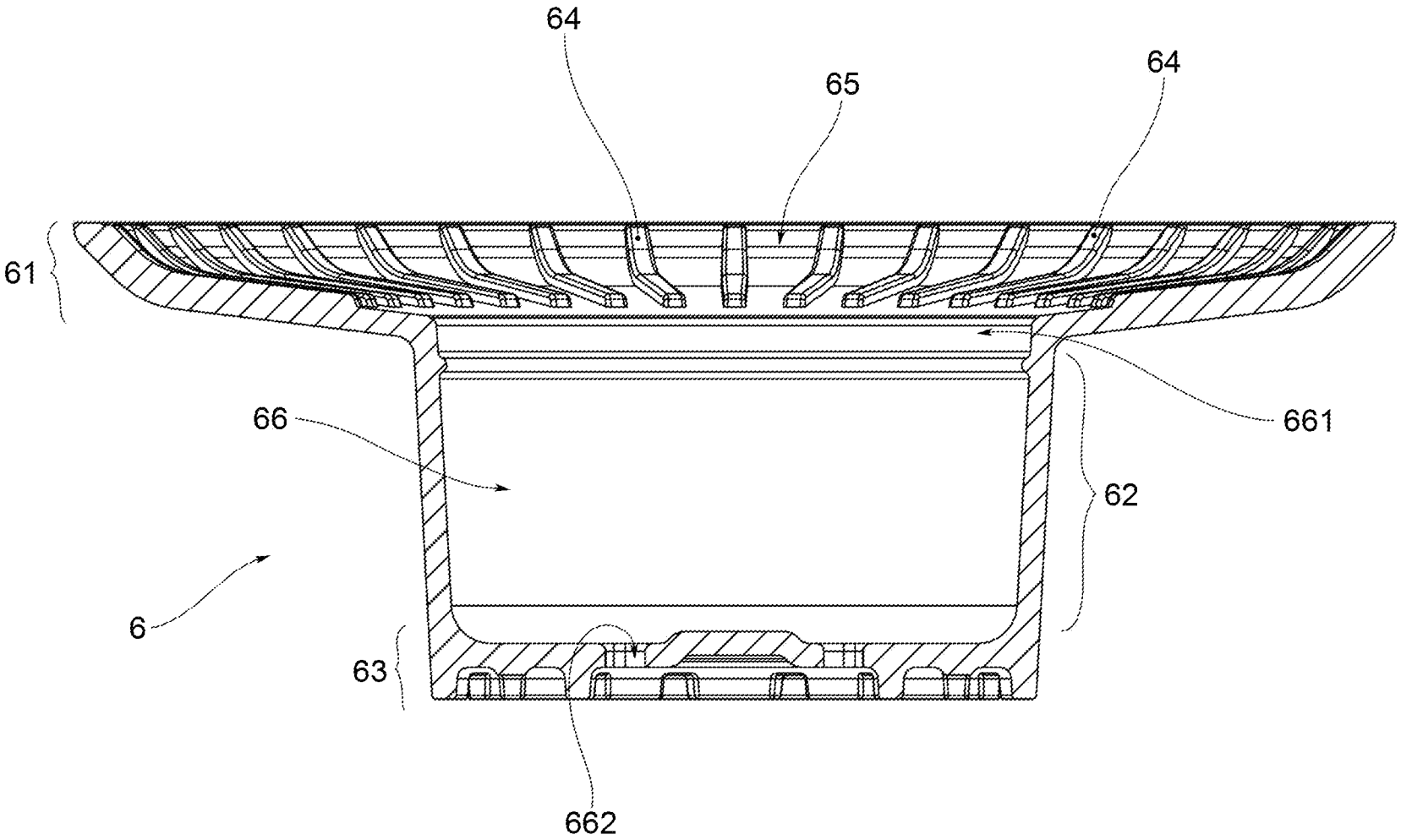
FIG. 4 shows a sectional view of a component of the capsule shown in FIG. 1, in particular of the mixing insert.

As shown in FIG. 3, the disc 5 is positioned between the containing volume VC and the lower wall 21, fixed below the substance 11, on the lower edge 23.

The disc 5 is weakly glued or welded, i.e. peelable, to the lower edge 23. For example, the disc 5 is glued using a low adhesion or weak glue, or is welded (for a certain time and welding temperature) in such a way as to detach from the lower edge 23 under certain pressure conditions inside the capsule 1.

Preferably, the disc 5 is able to detach from the lower edge 23 at a threshold pressure between 0.5 Bar and 1 Bar.

Preferably, the disc 5 is a film made of aluminum or a plastic/aluminum composite or fully plastic material, either single- or multi-layer.

The capsule 1 may be made in different versions, for example, for the preparation of infused beverages or soluble beverages.

Preferably, the capsule 1 for infusions (e.g. coffee powder or tea leaves) further comprises a filter disc (not shown), preferably made of paper or fabric or non-woven fabric, adapted to filter the infused liquid before it flows out of the capsule 1. The filter disc is fixed, below the substance 11 and above the sealing disc 5, on the lower edge 23.

The capsule 1 further comprises a mixing element 6 located inside the cup 2, between the sealing disc 5 and the lower wall 21, to allow the proper mixing of the substance before the beverage is discharged.

The mixing element 6 comprises several mixing portions, 61, 62, 63, which define mandatory passages for the fluid injected into the capsule and for the substance to be infused or dissolved before it flows out of the same capsule.

The mixing element 6 comprises a first collection and channeling portion 61, followed by a fall and collection portion 62, ending in a final mixing portion 63.

The first part of the collection and channeling portion 61 extends to just below the sealing disc 5, and is configured substantially as a circular crown with a flat or concave surface and extends substantially parallel to the lower wall 21. On such surface there is a plurality of reliefs 64 extending in a radial direction that form conduction channels 65. The presence of the reliefs 64 cause a series of whirls in the fluid that assist in properly mixing the alimentary substance and dissolving it in the fluid injected in the capsule 1.

The fall and collection portion 62 is defined by a chamber 66 that extends between a wide circular inlet opening 661 and a plurality of small outlet openings 662. The chamber 66 extends over the entire height of the mixing volume VM. The speed of the fluid entering in the chamber 66 is greater than the speed of the fluid leaving the same chamber: this creates turbulence in the chamber 66 which helps in mixing the food substance.

Finally, the final mixing portion 63 is defined between the outlet openings 662 made in the base of the mixing element 6 and the lower wall of the cup 2. Such final mixing portion 63 defines a winding and narrow path that completes the mixing of the food substance.

The mixing element 6, when inserted into the mixing volume VM of the cup 2, defines an annular and toroidal exit chamber 26 between itself and the side wall 22 and the lower wall 21.

When using the capsule 1 in an extraction machine, a perforating element 92 makes a hole in the base 21 of the cup 2 eccentrically relative to the Y-axis at the outlet chamber 26.

In the embodiments shown in the figures, the capsule 1 is symmetrical around the Y-axis and may be positioned within the extraction chamber of the machine without a preferred circumferential orientation, as the perforating element 92 will penetrate the lower wall 21 always at the outlet chamber 26. Moreover, the perforating element 92 penetrates the outlet chamber 26 at a maximum height which is lower than the height of the same outlet chamber 26.

The mixing element 6 is substantially composed of a rigid or semi-rigid structure that is placed inside the cup 2 of the capsule 1 and rests on the lower wall 21.

The mixing element 6 is, for example, interference-fitted below an annular stop 29 provided in the cup 2 just below the lower edge 23.

During use, the capsule 1 is inserted into the extraction chamber and such extraction chamber is closed. At this point, an injection needle 91 penetrates the capsule 1 through the lid 7 and the perforating element 92 penetrates the capsule 2 through the lower wall 21. The injection means of the machine, through the injection needle 91, inject water into the capsule 1 at the containing volume VC. The water permeates the food substance to extract it or dissolve it and to make a beverage. Due to the presence of the sealing disc 5, the flow of the beverage remains confined in the containing volume VC until an opening pressure is reached that causes the sealing disc 5 to detach from the lower edge 23.

The presence of the disc 5 to seal the containing volume VC allows the fluid to remain for a certain amount of time in contact with the substance 11 to be infused or dissolved to ensure an optimal infused beverage or a proper dissolving of the substance to be dissolved is achieved. The thrust exerted by the fluid inside the capsule 1 rises to reach a threshold value that causes the separation of the disc 5 from the lower edge 23. Such separation causes the sealing effect, previously ensured by the sealing disc 5, to fail.

Only at this point will the capsule be opened and the beverage may proceed towards the lower wall 21. The beverage then passes through all parts of the mixing element, undergoing changes of direction and whirls that lead to the formation of vortices in the flow of the beverage, vortices which help the food substance to fully dissolve.

The fully mixed beverage thus accumulates towards the lower wall 21 at the outlet chamber 26. Through the perforation needle 92, the beverage may then flow out of the capsule 1.

The capsule 1, in its various variant embodiments, may be used for the impromptu preparation of beverages (such as tea, coffee, herbal teas, milk, chocolate, soft drinks, juices, cocktails, etc.) by means of automatic or semi-automatic machines, wherein the perforation of the capsule is provided both in the lid and in the base.

Innovatively, a capsule for the preparation of infusion or soluble beverages according to the present invention may be used in percolation-type machines (low pressure), wherein the perforation of the capsule is envisaged both in the lid and in the base, but the opening of the capsule for discharging the infused beverage takes place only after the detachment of an internal sealing disc due to the pressure exerted by the fluid inside the capsule.

Advantageously, a capsule according to the present invention is particularly effective for preparing beverages from soluble substances or syrups, in that it is equipped with an internal mixer capable of ensuring the correct dissolving of the substance before discharging the beverage.

It is clear that one skilled in the art may make modifications to the above-described capsule, all contained within the scope of protection as defined by the following claims.

The invention claimed is:

1. A capsule for the preparation of infusion or soluble beverages for low pressure extraction systems, comprising:

a cup defining an inner volume comprising a lower wall intended to be perforated by the beverage extraction system for discharging the beverage, a side wall extending from the lower wall to a lower edge, the sidewall extending from the lower edge up to an upper edge, and an annular stop formed below the lower edge;

a lid, fastened to the upper edge, the lid closing the cup at the top and intended to be perforated by the extraction system for the injection of an extraction fluid;

a sealing disc inserted inside the cup and fastened at the lower edge, dividing the internal volume into a containing volume containing at least one food substance to be infused or dissolved, and a mixing volume for optimal mixing of the food substance in the extraction fluid, said sealing disc first sealing the containing volume at the lower edge and then detaching from the lower edge due to a pressure exerted by the fluid;

a mixing element positioned inside the cup between the sealing disc and the lower wall provided with a plurality of mixing portions adapted to create vorticity in the fluid to allow mixing of the food substance, wherein the mixing element comprises a first collection and channeling portion extending below the sealing disc in the form of a chamber with an extended concave flange and a base, wherein the rim of the concave flange is interference fitted to an underside the annular stop, the base of the mixing element comprises a plurality of small outlet openings; and a final mixing portion is defined between the small outlet openings and the lower wall of the cup.

2. The capsule according to claim 1, wherein said chamber being extended for an entire height of the mixing volume.

3. The capsule according to claim 1, wherein the mixing element, inserted into the mixing volume of the cup, defines an annular and toroidal outlet chamber between itself, the side wall and the lower wall adapted to receive a perforation element from the extraction system for discharging the beverage.

4. The capsule according to claim 1, wherein the mixing element is a rigid or semi-rigid structure inserted inside the cup and rests on the lower wall.

5. The capsule according to claim 1, wherein the sealing disc is positioned between the containing volume and the lower wall, fixed below the substance, on the lower edge, and detachable from the lower edge at a threshold pressure between 0.5 bar and 1 bar.

* * * * *